US005851350A

United States Patent [19]

Timperi

[11] Patent Number: 5,851,350

[45] Date of Patent: Dec. 22, 1998

[54] METHOD AND APPARATUS FOR PUMPING CELLULOSE PULP

[75] Inventor: Jukka Timperi, Kotka, Finland

[73] Assignee: A. Ahlstrom Corporation, Noormarkku, Finland

[21] Appl. No.: 771,064

[22] Filed: Dec. 20, 1996

Related U.S. Application Data

[60] Provisional application No. 60/009,279, Dec. 27, 1995.

[51] Int. Cl.[6] ..... D21C 7/08

[52] U.S. Cl. ..... 162/52; 162/246; 162/57

[58] Field of Search ..... 162/52, 57, 65, 162/237, 246

[56] References Cited

U.S. PATENT DOCUMENTS

| | | | |
|---|---|---|---|
| 2,960,161 | 11/1960 | Richter | 162/246 |
| 3,096,234 | 7/1963 | Armstrong et al. | 162/246 X |
| 4,884,943 | 12/1989 | Niskanen | 415/143 |
| 5,106,456 | 4/1992 | Voitto et al. | 162/17 |
| 5,411,633 | 5/1995 | Phillips et al. | 162/52 |

*Primary Examiner*—Stanley S. Silverman
*Assistant Examiner*—Jose S. Fortúne
*Attorney, Agent, or Firm*—Nixon & Vanderhye P.C.

[57] ABSTRACT

Pumping of medium consistency cellulose pulp is effected from stand pipes or like small sized pulp vessels to which pulp is normally discharged from storage towers, treatment towers, washers, filters, presses, thickeners, or the like, particularly pumping of high temperature pulps from said stand pipes. A pump inlet is attached to a discharge opening of a stand pipe, pressurizing cellulose pulp in said stand pipe by closing the stand pipe off from the atmosphere, maintaining a superatmospheric pressure in the stand pipe, allowing the cellulose pulp to flow into the pump through the pump inlet, and pumping the cellulose pulp further using the pump.

12 Claims, 5 Drawing Sheets

METHOD AND APPARATUS FOR PUMPING CELLULOSE PULP

CROSS-REFERENCE TO RELATED APPLICATION

This application is based on provisional application Ser. No. 60/009279 filed Dec. 27, 1995.

BACKGROUND AND SUMMARY OF THE INVENTION

The present invention relates to pumping of medium consistency cellulose pulp. The invention is especially concerned with pumping of pulps from stand pipes or like small sized pulp vessels to which pulp is normally discharged from storage towers, treatment towers, washers, filters, presses, thickeners etc. More specifically the invention relates to the pumping of high temperature pulps from the stand pipes.

In the pumping of medium consistency pulp the gas content of the pulp is a well-acknowledged problem. A somewhat less well-known problem relates to the presence of steam in the pulp, or the formation of steam in the pulp under certain process conditions. This phenomenon, i.e. the problems based on the presence of gas in the material to be pumped, is a result of the operation of the centrifugal pump used for pumping pulp. A centrifugal pump, no matter whether it is an ordinary centrifugal pump or a fluidizing centrifugal pump (MC® pump) capable of pumping medium consistency pulps, tends to create a certain suction head at its inlet. This reduced pressure lowers the boiling point of the liquid present in the pulp. This factor together with the high surface friction between the pulp and the inlet channel of the pump which prevents the pulp from flowing smoothly into the impeller eye makes the liquid in the pulp boil and creates steam under certain conditions. This is especially true at higher pulp consistencies since the higher the consistency (medium consistency pulp typically having a consistency between about 8–18%), the easier significant amounts of steam are created.

The problems are more severe when pumping pulps at high temperature (i.e. above about 80° C.), as often occurs with modern pulp mills where the discharge from digesters and bleaching vessels is practiced at temperatures close to the boiling point of water. It would be advantageous to be able to pump pulp having a temperature above 100° C. from one process step to another. The kind of steam formation discussed above affects the pumping ability of the pump in a significant way e.g. by forming a steam bubble in front of the pump impeller, resulting in a number of undesirable consequences.

The basic problem hindering the pumping i.e. the formation of a gas or steam bubble in front of the centrifugal impeller, is overcome by utilizing means for separating gas, or steam, from the pulp in the centrifugal pump and by utilizing means for discharging gas from the gas bubble in such an amount that the size of the gas bubble remains at a desired level. Examples of these are disclosed in U.S. Pat. Nos. 5,078,573, 5,114,310, 5,116,198, 5,151,010, and 5,152,663, and in EPB-0 478 228. These pumps are provided with a gas flow channel, normally leading through the impeller to the backside of the impeller and then to the vacuum pump (disposed either on the same shaft as the centrifugal impeller or on a shaft separate from the centrifugal pump), and from there to the atmosphere or to some other location, for instance, to a gas collection system.

In these pumps the gas, and steam, separation is effected by both spirally rotating the pulp in the inlet channel, the suction created by the centrifugal impeller, and, possibly, the suction created by the vacuum pump. The removal of gas, or steam from the pump requires a certain pressure differential between the bottom of the stand pipe and the gas discharge, preferably provided with a vacuum pump. A stand pipe is a relatively small size vessel which receives pulp from a washer, thickener, bleaching tower, or storage tower in a conventional pulp mill (typically a kraft pulp mill). While the term "stand pipe" is used in the present specification and claims it is to be understood that this term encompasses similar small vessels which may not be technically known as a "stand pipe" in the pulping art. The required pressure difference is the sum of the subatmospheric pressure created by the vacuum pump and the net positive suction head i.e. the inlet pressure. However, the maximum value of the subatmospheric pressure is dictated by the temperature of the pulp in the pump inlet. If the temperature is for instance close to 100° C. with a low inlet height there cannot, in practice, be any suction created by the vacuum pump so that the gas or steam is discharged merely as a result of the inlet pressure. This also ensues even if the inlet height as such is high but the pulp is of particularly high consistency so that the surface friction lowers the effective pressure to a very low value.

In addition to separating gas the suction (i.e. reduced pressure) lowers the boiling point of water facilitating steam formation. If steam starts to formate there is, in practice, no limit to the amount of steam formed so that the gas separation system is overloaded i.e. it is not able to remove all the steam thereby adversely affecting. This type of a steam creation can be overcome by several measures: lowering the temperature of the pulp, increasing the inlet height of the pulp, or pressurizing the pump inlet. Lowering of the temperature is, in practice, out of the question as modern mills demand that most operations be performed at a temperature close to, or sometimes even above, 100° C. The increase of inlet height i.e. the net positive suction head, is often impossible due to the constructional limitations at the pulp mill e.g. if a washer is disposed on the first floor of the pulp mill it is impractical to position the stand pipe and the pump in a deep hole below the ground floor. Also with higher consistencies it becomes impossible, or senseless, to increase the height of the stand pipe as the surface friction between the pulp and the stand pipe wall in any case lowers the true effective pressure at the bottom of the stand pipe. The pulp "hangs" on the wall of the stand pipe and does not flow easily downwardly. A solution to this problem would be to increase the conicity of the stand pipe i.e. make the stand pipe widen more rapidly downwardly. However, this would lead to an impossible structure as the diameter of the bottom of the stand pipe would grow so wide that a substantial portion of pulp would remain standing on the pipe bottom resulting in arching problems in front of the discharge outlet of the stand pipe.

In other words, the only practical solution to the steam formation problem is to pressurize the pump inlet. In the prior art a few devices which may be used for solving at least some of the above mentioned problems are proposed. However, these problems have so far not been discussed extensively in patent documents or in the literature. The prior art typically discusses means for pressurizing the centrifugal pump inlet, usually the inlet of an MC® pump. Such apparatus have been shown in U.S. Pat. Nos. 4,877,368, 4,884,943, 5,000,658, and 5,106,456. Also a number of other patent documents and articles describe similar devices for similar purpose. In FIGS. 1 through 4 some other structural embodiments for performing the task of feeding pulp into the inlet of a discharge pump have been shown.

However, it has been recognized that arranging a feeder device at the bottom of a stand pipe necessarily ensures neither a trouble-free operation nor is it the most cost-effective way of solving the problems. In fact, as long as medium consistency pulp has been transferred from any pulp containing vessel to another process step or the like by using a centrifugally operating pump, especially the discharge of the pulp, from the vessel has been problematic. Either the pulp did not flow well to the pump impeller or, when feeder devices have been used to ensure the pulp flow, the pulp did not flow steadily to the feeder device. In other words, the medium consistency pulp has formed an open cavity around and above the feeder device. This phenomenon has been called arching of the pulp.

Normally, the arching of the pulp has been prevented by ensuring a sufficient inlet height in the stand pipe, or providing a downwardly widening structure of the stand pipe, or providing a large vertical feeder screw in the stand pipe etc. Also, there have been suggestions (e.g. see U.S. Pat. No. 5,106,456) to recirculate part of the outlet flow of the discharge pump back to the pulp in the stand pipe. The purpose for such a recirculation is to introduce homogenized, and most probably degassed, dense pulp into the pulp in the stand pipe to press the contents of the stand pipe steadily downwardly.

However, the above discussed means for ensuring the pulp flow into the centrifugal pump have, in addition to the above mentioned drawbacks, yet another characterizing feature which makes their use less attractive. All the above discussed devices require some sort of feeder apparatus positioned inside the stand pipe, most often at the bottom portion of the stand pipe. Such a feeder apparatus is itself expensive as it has to have a rugged construction due to the fact that they have to endure all the physical and dynamic stresses caused by handling of medium consistency pulp. Also for the same reason such prior art devices require a very efficient drive means for rotating their rotor. And finally, the position of a feeder at the bottom of the stand pipe requires that a complicated construction of the bottom portion of the stand pipe, increasing its cost. In other words, it becomes very expensive to ensure the steady pulp flow to a centrifugal pump by using the devices in accordance with prior art. And still one cannot be sure that the pulp flows steadily downwardly in the stand pipe since usually no measures have been taken to ensure the pulp flow downwardly in the stand pipe.

Yet, there is one limitation in using an ordinary stand pipe which is substantially open to atmosphere. Being open to atmosphere also means that the temperature of pulp cannot exceed 100° C., otherwise the water in pulp would start boiling.

According to the present invention the problem with the decrease of the pumping ability is solved by pressurizing the inlet opening of the pump in a totally different manner. This is done by pressuring a stand pipe to which the pump inlet is connected. In addition to solving the problem relating to a low pressure in the pump inlet, the problem relating to the weak flow of pulp down into the stand pipe has also been solved in a novel and inventive way. And finally the solution offers the opportunity to use, in practice, unlimited temperature in the stand pipe so that it becomes possible to operate, for instance, a sequence of bleaching towers and intermediate pressurized washers, thickeners and filters, continuously at a temperature exceeding 100° C.

In SE-B-426959 a disc filter is disclosed which has been pressurized by means of blowing air through the shaft of the disc filter into the filter sectors so that the thickened pulp cake is removed by pressurized air. Simultaneously with the discharge of the cake the air pressurizes the interior of the disc filter as well as the discharge chute of the filter. The discharge chute is provided with a longitudinal feed screw for feeding pulp to an end of the apparatus where the pulp enters at substantially the same vertical level another feed chute where another screw feeds the pulp into a thick stock pump which is a positive displacement type pump. In the specification is has been explained that the thick stock pump is the final pressure lock which ensures that the pressure is at a predetermined level within the disc filter. In other words, the operation of the above described device is such that there is hardly any stiff pulp plug upstream of the thick stock pump but that the thick stock pump itself, due to its mechanical construction acts as a pressure lock. At least it is clear that the thick stock pump does not utilize the pressure within the disc filter.

The above described problems have been solved by the novel method of pumping cellulose pulp having a consistency of between about 8–18% according to the invention. The method comprises the steps of: (a) Attaching the pump inlet to the discharge opening of a stand pipe. (b) Pressuring cellulose pulp having a consistency of between about 8–18% in the stand pipe by closing off the stand pipe from atmosphere. (c) Maintaining a superatmospheric pressure in the stand pipe. (d) Causing the cellulose pulp to flow into the pump through the pump inlet. And, (e) pumping the cellulose pulp away from the stand pipe using the pump.

Another preferred feature of the method is the formation of a gas space above the pulp by pressurizing, utilizing a pressurizing gas, the stand pipe to thereby force the pulp into the pump inlet under the influence of both gravity and fluid pressure.

The apparatus for practicing the above method comprises a stand pipe having a top portion and a bottom portion, a pulp pump having an inlet, the inlet to the pulp pump being connected to the bottom portion of the stand pipe so that pulp may flow from the bottom portion of the stand pipe to the pump inlet. In the apparatus the stand pipe is preferably closed off from the atmosphere and has a gas space at the top portion thereof.

DETAILED DESCRIPTION OF THE DRAWINGS

Figure 1A:
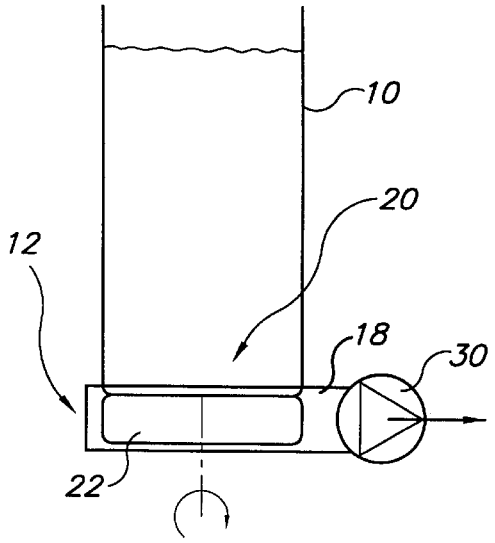
FIGS. 1*a* and 1*b* are schematic side cross-sectional and top views of a first exemplary apparatus for assisting the discharge of medium consistency pulp from a stand pipe.
Figure 1B:
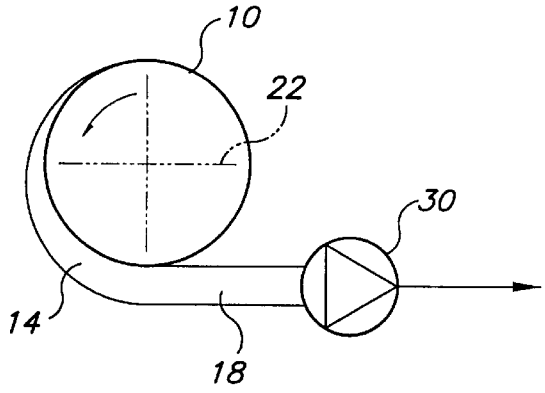

In FIGS. 1*a* through 4 there are illustrated different feeder devices which may be used for assisting the discharge of medium consistency pulp from a stand pipe. FIGS. 1*a* and 1*b* show a first exemplary apparatus for discharging pulp from a stand pipe. The bottom of the stand pipe 10 is provided with a rotor 20 which acts like a centrifugal pump feeding pulp towards the outlet opening and the pump 30 (e.g. an MC® pump such as sold by Ahlstrom Pumps Corporation) attached thereto. The rotor 20 may have either straight or curved vanes 22. If the vanes 22 are straight they may be either radial or inclined. The bottom area 12 of the stand pipe 10 surrounding the rotor 20 may be circular with a tangential outlet 18 or it may preferably be formed like a spiral housing 14 of a centrifugal pump. The axis of the rotor 20 may be vertical, as shown in FIG. 1*a,* but it may alternatively be inclined if the bottom of the stand pipe 10 is not horizontal. The stand pipe 10 preferably has a cross-sectional area that increases from the top towards the bottom so that the pulp flows easily downwards due to gravity. However, especially at lower consistencies, the walls of the stand pipe 10 alternatively may be parallel, preferably horizontal, or inclined, or vertical.

Figure 2A:
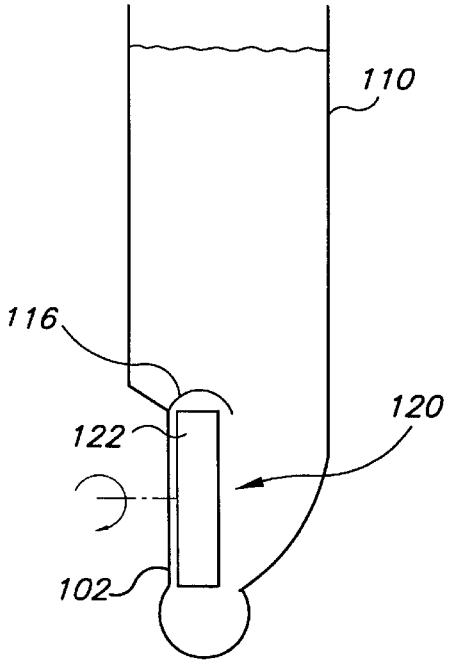
FIGS. 2*a* and 2*b* are views like those of FIGS. 1*a* and 1*b* only of a second exemplary apparatus.
Figure 2B:
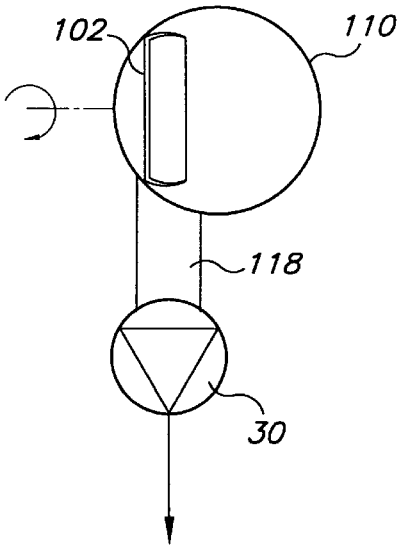

FIGS. 2*a* and 2*b* show a second exemplary apparatus for discharging pulp from a stand pipe. In FIG. 2*b,* there is shown a rotor 120 positioned to rotate in a vertical plane about a horizontal axis. The rotor 120 is surrounded by either a substantially cylindrical volute or a spiral volute 116 having a tangential outlet 118 to which a conventional pump 30 (e.g. an MC® pump) is further attached. As shown in the drawings at least the bottom portion of the stand pipe 110 is provided with a planar wall portion 102 through which the drive of the rotor is disposed. Though the drawings illustrate a horizontal axis for the rotor, the axis also can be inclined.

Figure 3A:
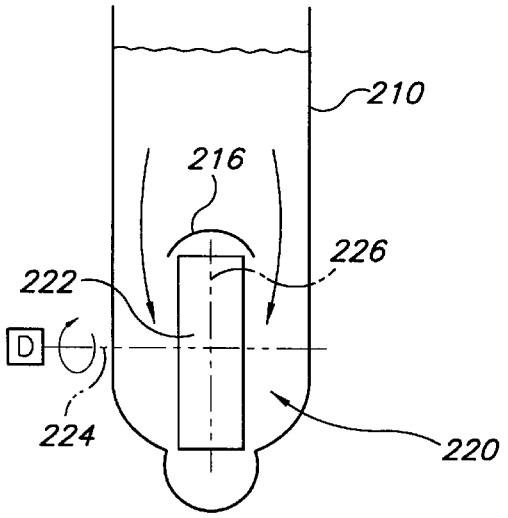
FIGS. 3*a* and 3*b* are views like that of FIGS. 1*a* and 1*b* except of a third exemplary apparatus.
Figure 3B:
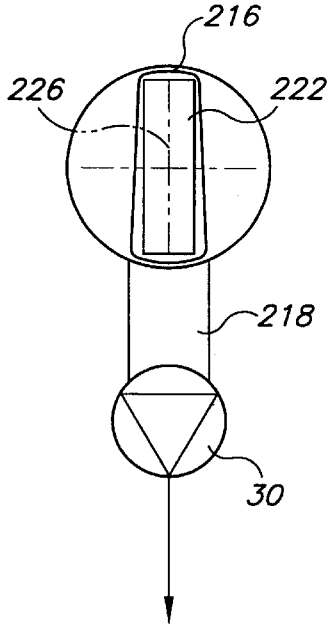

FIGS. 3*a* and 3*b* show a third exemplary apparatus for discharging pulp from a stand pipe. In this embodiment, the horizontal shaft 224 of the rotor 220 is, preferably, extended across the stand pipe 210 so that it is supported by bearings both at its drive (D) end and its free end. Preferably, the rotor 220 is disposed substantially centrally in the stand pipe 210 bottom area. Since the rotor 220 is of a double suction type, the rotor 220 preferably has a central plate 226 on both faces, to which curved or straight vanes 222 are attached. The rotor 220 is surrounded by either a cylindrical or, preferably, a spiral housing 216 having a tangential outlet 218 attached to the conventional pump 30.

Figure 4:
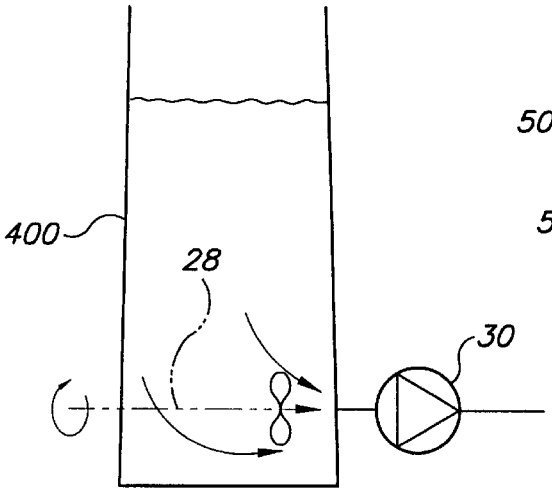
FIG. 4 illustrates a fourth exemplary apparatus.

FIG. 4 illustrates a fifth exemplary apparatus for discharging medium consistency pulp from a stand pipe. At the bottom of the stand pipe 400 there is a propeller 28 feeding pulp towards the pump 30 discharging pulp from the stand pipe 400. In accordance with a preferred characterizing-feature of this embodiment the rotational speed of the propeller 28 is higher than that of the impeller of the pump 30, preferably by at least 5%, more preferably by at least 10%. However, it has to be understood that the propeller could be replaced with a feeder screw, or a set of feeder blades or vanes attached either on the same shaft with the centrifugal impeller or on a separate shaft driven by another drive (e.g. motor).

All the feeder devices of FIGS. 1*a*–3*b* as well as the device of FIG. 4 lack means for ensuring the pulp flow downwardly into the eye of the impeller. The devices also cannot overcome arching if it occurs. The solution to this problem is discussed in connection with the following examples.

Figure 5:
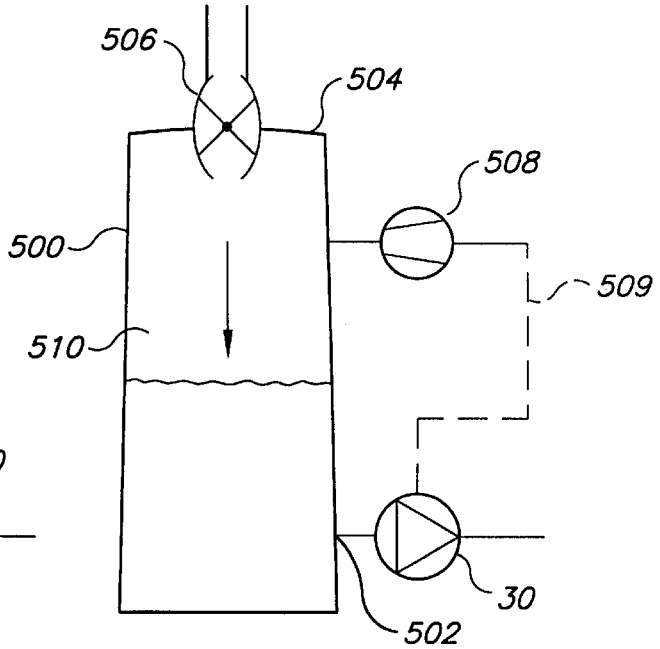
FIG. 5 is a schematic side cross-sectional view of a first preferred embodiment of an apparatus according to the invention.

FIG. 5 illustrates a first preferred embodiment of the present invention. The stand pipe 500 is provided with an upright pressurized housing having at its upper end a pressure cover 504. The pressure cover is provided with a pocket feeder 506 (the elements 504, 506 collectively comprising one example of a means for allowing the stand pipe 500 to be maintained at superatmospheric pressure). The pocket feeder 506 could be replaced with an arrangement having two valves, gates or ports arranged in series and having a pulp chamber in between the valves, ports or gates being operated in such a manner that while the "lower" valve is closed the "upper" one is open allowing the chamber to fill and then after closing of the "upper" valve the "lower" one is opened so that the pulp chamber could be emptied, or a piston feeder, or a suitable positive displacement pump, or some other appropriate means for transporting pulp from a lower pressure to a higher pressure. It should however be understood that the transporting means does not necessarily have to be positioned at the pressure cover but it may alternatively be located at the substantially vertical wall of the pressure housing, for instance.

The pressure housing, i.e. the stand pipe 500, is preferably substantially cylindrical and/or slightly downwardly widening. At its lower end the stand pipe 500 is provided with an outlet opening 502 and with a centrifugal pump 30 disposed in communication with the outlet opening 502. The centrifugal pump 30 is preferably a fluidizing centrifugal pump i.e. an MC® pump. The stand pipe 500 is further provided with means 508 for pressurizing the interior cavity of the stand pipe 500 i.e to form therein a gas space 510. The pressurizing means 508 is, for instance, a vacuum pump sucking (e.g. through line 509) gas, or steam, from the pump 30 discharging pulp from the stand pipe 500 and feeding the separated gas/steam back to the stand pipe 500. It should be understood that the operation principle of a vacuum pump connected to a centrifugal pump for degassing thereof is oftentimes such that the vacuum pump maintains a certain subatmospheric pressure in the centrifugal pump. Also since the vacuum pump has been normally dimensioned in such a manner that it is always able to draw all the gas from the centrifugal pump i.e. it is in essence over dimensioned it has been provided with a structure for drawing additional air from the atmosphere. With both the gas separated from the pulp and additional air, the vacuum pump is able to pressurize the gas space of the stand pipe. Almost inevitably some gas will escape through the feeder means upstream in the pulp line and also some gas will end up in the spaces between pulp particles and be drawn into the pump. In other words, the additional, make-up, air will compensate for the gas that has escaped from the stand pipe. The above described use of the degassing vacuum pump is a very cheap and convenient way of pressurization of the stand pipe. Oftentimes the discharge of the degassing vacuum pump is directed into the stand pipe as in some cases some fibers may be drawn into the degasifying system so that the fibers are returned into the stand pipe and back to use. Pressurization may alternatively be effected by a totally independent pump means, for example a compressor or a blower for pumping outside air, some other gas, or steam, into the stand pipe 500. Also, it is clear that the pressurization of the stand pipe may be effected from the pulp mill's pressurized air pipelines without any separate devices to effect pressurization.

Figure 6A:
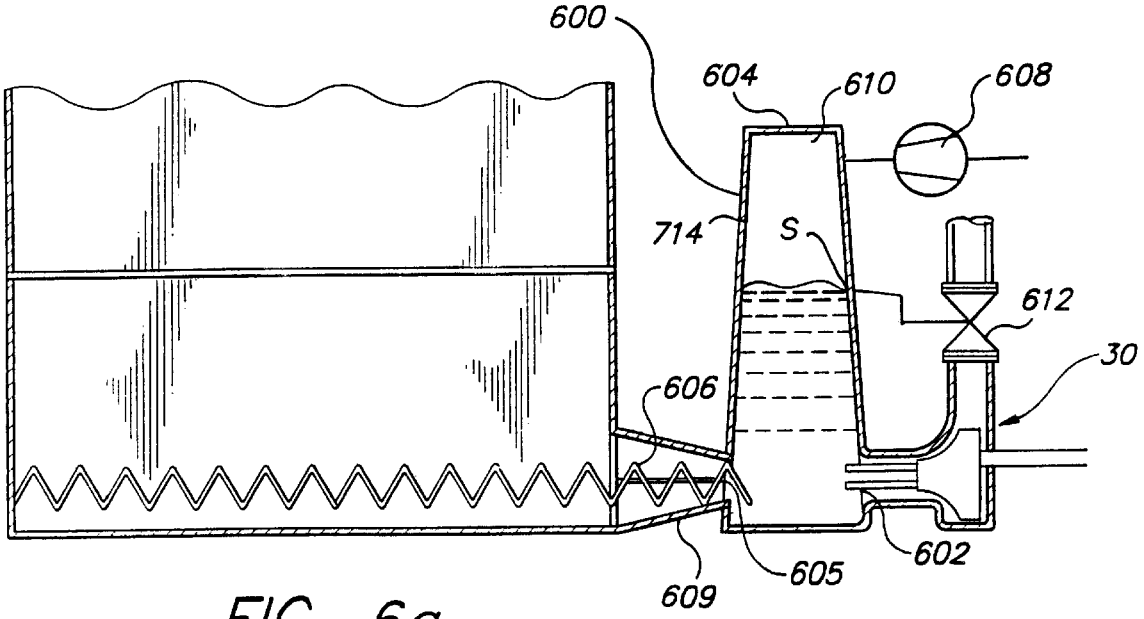
FIGS. 6*a* and 6*b* are schematic side cross-sectional views of a second and third preferred embodiments of an apparatus according to the invention.
Figure 6B:
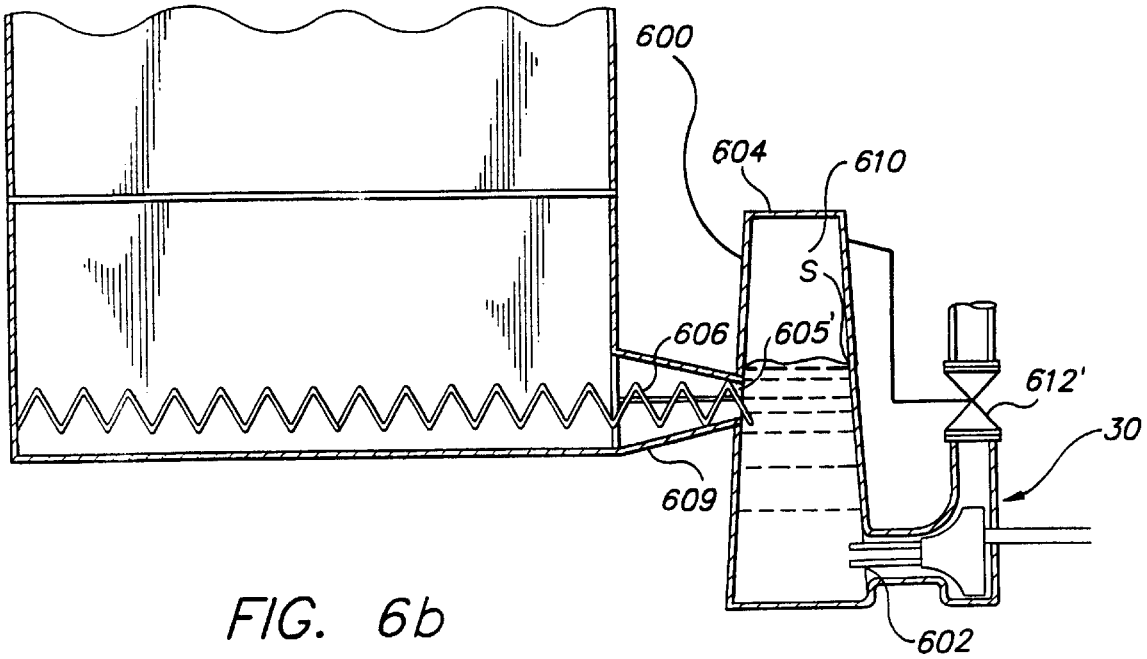

FIGS. 6*a* and 6*b* illustrate another preferred embodiments of the present invention. The stand pipe of FIGS. 6*a* and 6*b* is composed of a vertically oriented, preferably, due to ease of manufacture, substantially cylindrical pressure housing 600 and at its upper end a pressure cover 604. The bottom end of the stand pipe 600 is provided with an outlet opening 602 for the discharge of the fiber suspension using a centrifugal pump 30 which may be either a fluidizing centrifugal pump i.e. a MC® pump or an ordinary, non-fluidizing, centrifugal pump. The bottom end of the stand pipe of FIG. 6*a* is also provided with an inlet opening 605 for receiving pulp from a preceding process step. The wall of the stand pipe 600 of FIG. 6*b* is provided close to the pulp surface S, preferably therebelow, with an inlet opening 605' for receiving pulp from a preceding process step. In both of these embodiments the inlet opening 605 and 605' is provided with an inlet pipe 609 converging towards the inlet opening 605 and 605'. A feed means 606, in this embodiment a feed screw, is arranged to extend from outside the stand pipe 600 into the inlet pipe 609 to feed pulp in a steady flow through the inlet pipe 609 and inlet opening 605 and 605' into the stand pipe 600. When being pressed towards the inlet opening 605, 605' within the converging inlet pipe 609 the pulp forms a plug which allows the stand pipe 600 to be at a superatmospheric pressure.

A few alternatives to maintain a certain pressure, and a gas space 610, within the stand pipe 600. The first alternative is equal to the one discussed in connection with FIG. 5, i.e. the use of a compressor or some other means at the upper end of the stand pipe 600 for pressurizing the stand pipe 600. Another alterative is, while starting the process, to start filling the stand pipe 600 without yet starting the centrifugal pump 30. In other words, the stand pipe 600 is filled up to certain level S to form a gas space 610 and to reach a desired pressure at the top end of the stand pipe 600 whereafter the centrifugal pump 30 is started. The process would, then, be run in such a manner that the pulp level S in the stand pipe 600 is maintained at the desired height dictated by the pressure at the top end of the stand pipe 600. The pump capacity may be adjusted by means of a valve 612 regulating the outlet flow from the pump 30 as a function of the pulp level S or by means of a valve 612' regulating the outlet flow from the pump 30 as a function of the pressure in the gas space 610. It is also possible to arrange a compressor 608 (shown in FIG. 6*a*) or some other means for pressurizing the stand pipe 600 if deemed necessary. The best way to control the operation of the stand pipe is to separately monitor the pressure within the gas space and the pulp level in the stand pipe 600. In other words, the compressor 608 or blower is regulated to provide a constant pressure in the gas space, and the outlet flow of the centrifugal pump is regulated to maintain the pulp level S in the stand pipe at an optimal value, or between certain, upper and lower, limits. Naturally it is clear that the position of the inlet opening 605 and 605' and the way of controlling the outlet flow of pump 30 are not interconnected as shown in the FIGURES but valve 612' may be used with the inlet opening 605 positioned at the bottom of the stand pipe 600 as well as valve 612 in connection with an inlet opening 605' positioned higher at the wall of the stand pipe 600.

Figure 7A:
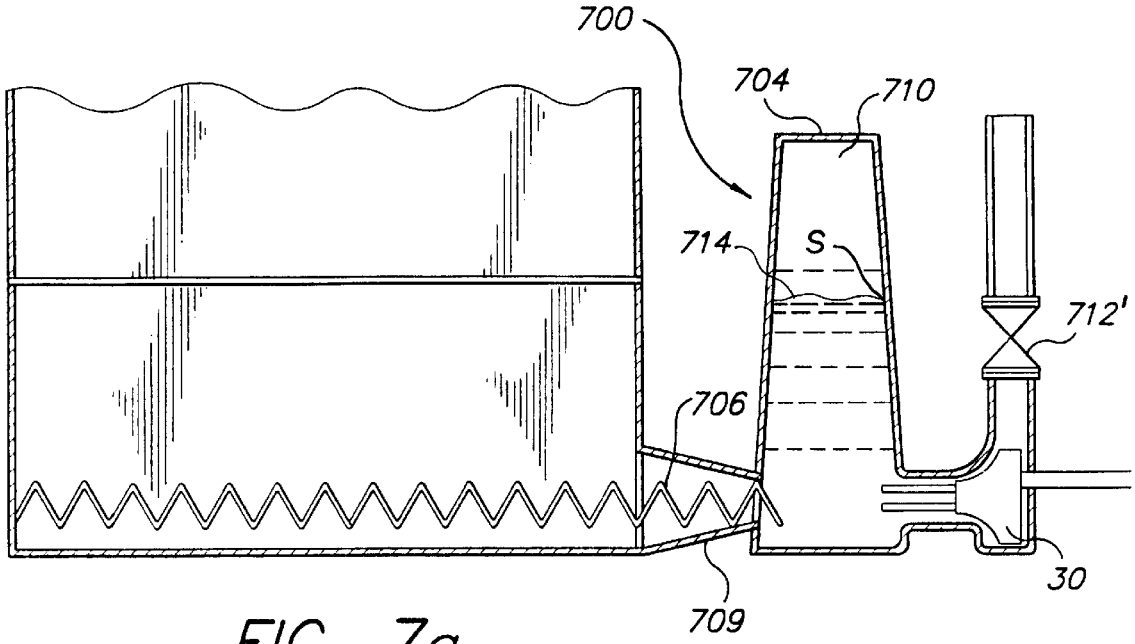
FIGS. 7*a* and 7*b* are schematic side cross-sectional views of fourth and fifth preferred embodiments of an apparatus according to the invention.
Figure 7B:
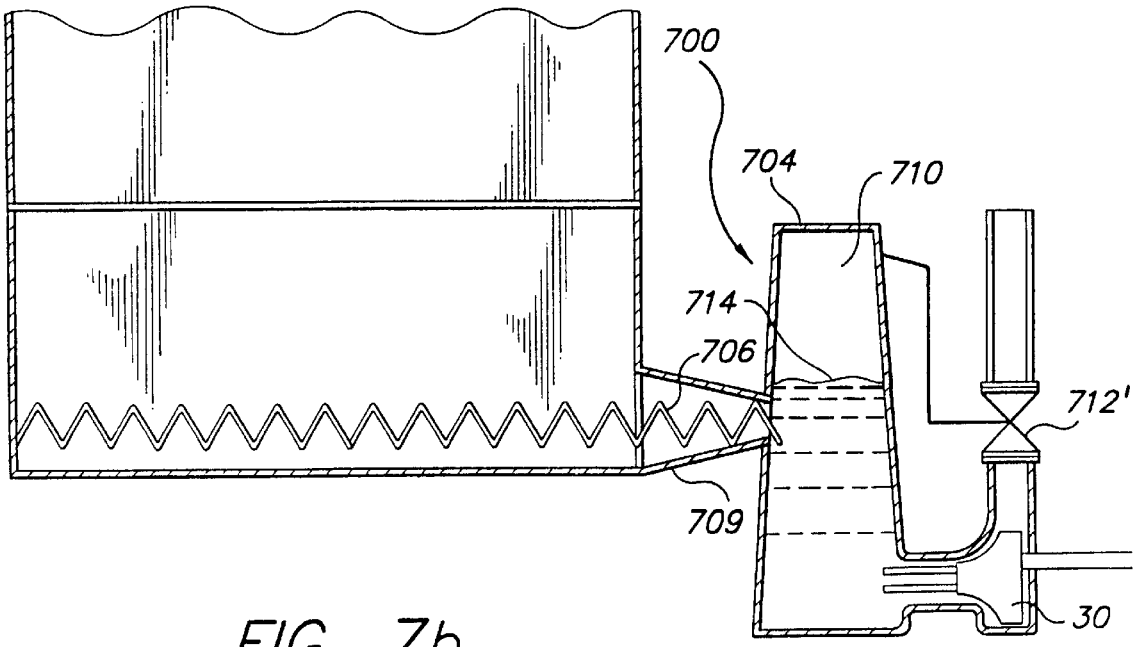

In FIGS. 7*a* and 7*b* the arrangement is basically the same as the one shown in FIGS. 6*a* and 6*b* except the structure of the top portion of the stand pipe 700. Thereby the reference numerals stand for the same components except that the leading numeral is '7'. In this embodiment the interior of the stand pipe is provided with a membrane 714 attached to the substantially vertical wall of the stand pipe 700. The membrane is preferably made of rubber or some other material suitable for the purpose. The membrane 714 separates the pulp space at the bottom portion of the stand pipe 700 from the gas space 710 at the top portion of the stand pipe 700. This kind of a physical separation of the pulp from the pressurized gas ensures that the gas does not get mixed with the pulp. The pressurization of the gas space 710 may be performed with the same means discussed already above in connection with the earlier embodiments. In FIG. 7*b* it has been shown how the pressure valve 712' of the pump may be adjusted relative to the pressure in the gas space. This kind of adjustment ensures that there is always a sufficient amount of pulp in the stand pipe i.e. one is not able to empty the stand pipe 700.

Figure 8:
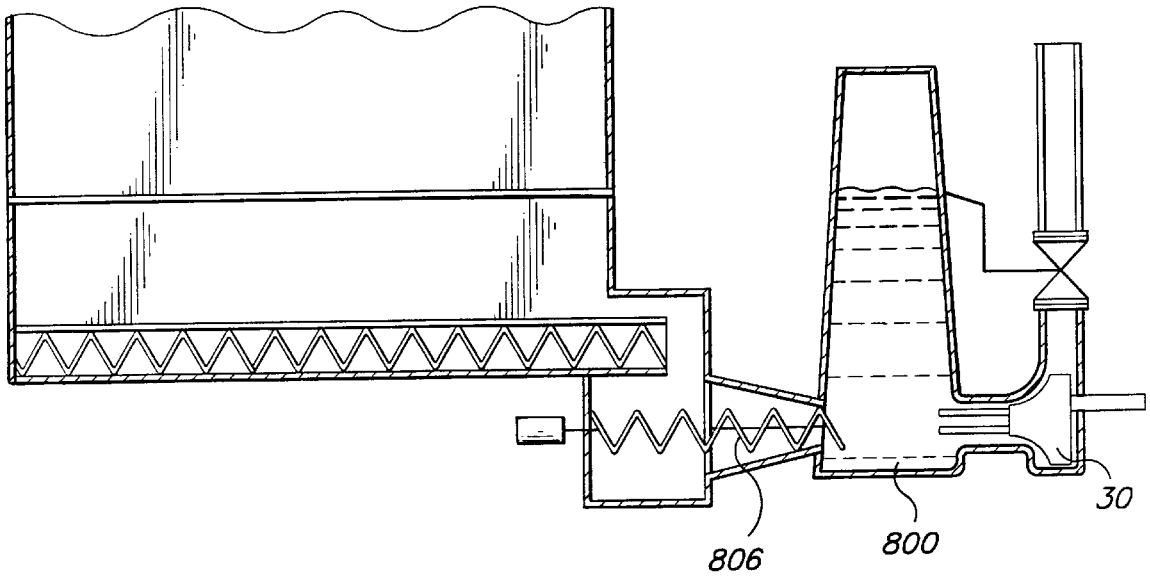
FIG. 8 is a schematic side cross-sectional view of a sixth preferred embodiment according to the invention.

The feed means 606 and 706 cited above may be either combined with means for discharging pulp from a discharge chute of a drum or a disc washer or thickener as shown in FIGS. 6*a*, 6*b*, 7*a*, and 7*b*, or they may be, as shown in FIG. 8, separate means 806 just for feeding pulp into the stand pipe 800. In fact, for instance, feed means 706 have been shown as an extension of a screw feeder used for discharging pulp from a drum or a disc filter or washer. Though all the above FIGS. 6*a*–8 show the combination of the stand pipe to a preceding washer, filter or thickener it should be understood that the stand pipe with its feed, discharge and pressurization means may be connected to all such positions where a stand pipe is needed. Also the positioning of the inlet opening in the wall of the stand pipe is not that critical except that it is desirably positioned below the pulp surface, or if the membrane is used, below the membrane. The closer the inlet opening is to the pulp surface in the stand pipe the better it has been ensured that pulp cannot stay a long time in the stand pipe. However, if such is not considered a risk it is possible to arrange the feed of the pulp into the stand pipe through the bottom thereof. It is also possible to extend the inlet pipe through the bottom of the stand pipe to such a height that it discharges pulp to the surface of the pulp in the stand pipe.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of pumping cellulose pulp having a consistency of between about 8–18% by utilizing a pump having a pump inlet and a stand pipe with a discharge opening, comprising the steps of:

(a) attaching the pump inlet to the discharge opening of the stand pipe;

(b) closing the stand pipe from the atmosphere;

(c) pressurizing cellulose pulp having a consistency of between about 8–18% and feeding the pulp at a consistency of 8–18% under pressure into the stand pipe to establish a level of pulp in the stand pipe and a gas space above the pulp level, and maintaining a superatmospheric pressure in the stand pipe gas space;

(d) causing the cellulose pulp to flow into the pump through the pump inlet; and (e) pumping the cellulose pulp, at substantially the same consistency between about 8–18% as the pulp feed into the stand pipe in step (d), away from the stand pipe using the pump.

2. A method as recited in claim 1 wherein the cellulose pulp has a temperature of about 80° C. or above during the practice of steps (c)–(e).

3. A method as recited in claim 1 wherein step (c) is practiced to minimize the amount of steam created by action of the pump on the pulp in the practice of step (e).

4. A method as recited in claim 1 wherein step (a) is practiced so that the stand pipe is connected adjacent a bottom portion thereof to the pump inlet.

5. A method as recited in claim 1 wherein a valve is provided in a conduit through which the pulp is pumped in the practice of step (e); and comprising the further step of controlling the valve in response to the pressure in the gas space in the stand pipe.

6. A method as recited in claim 1 wherein step (c) is practiced in art by feeding a pressurizing gas into the stand pipe so that the superatmospheric pressure in the stand pipe causes the pulp to be forced into the pump inlet under the influence of both gravity and fluid pressure.

7. A method as recited in claim 6 wherein step (c) is practiced to compress atmospheric gas, and to force the compressed atmospheric gas into the gas space in the stand pipe.

8. A method as recited in claim 1 further comprising the steps of (f) separating gas from the pulp in the pump during the practice of step (e) and (g) introducing the separated gas back to the stand pipe to assist the practice of step (c).

9. A method as recited in claim 8 wherein step (g) is practiced to return the separated gas to the gas space of the stand pipe.

10. A method as recited in claim 9 comprising the further step (h) of adding additional gas under pressure to the gas returned in step (g) to the gas space of the stand pipe.

11. A method as recited in claim 9 wherein a valve is provided in a conduit through which the pulp is pumped in the practice of step (e); and comprising the further step of controlling the valve in response to the pressure in the gas space in the stand pipe.

12. A method of pumping cellulose pulp having a consistency of between about 8–18% by utilizing a pump having a pump inlet and a stand pipe with a discharge opening, comprising the steps of:

(a) attaching the pump inlet to the discharge opening of the stand pipe;

(b) closing the stand pipe from the atmosphere;

(c) establishing a level of pulp in the stand pipe, and a gas space above the level of pulp;

(d) causing the cellulose pulp to flow into he pump through the pump inlet;

(e) pumping the cellulose pulp away from the stand pipe using the pump;

(f) separating gas from the pulp in the pump; and (g) introducing the separated gas from the pump to the gas space in the stand pipe to at least assist in maintaining a superatmospheric pressure in the stand pipe so as to minimize the amount of steam created by action of the pump on the pulp.

* * * * *